US005937258A

United States Patent [19]

Acquaviva et al.

[11] Patent Number: 5,937,258

[45] **Date of Patent: *Aug. 10, 1999**

[54] PAPER CONDITIONER WITH ARTICULATING BACK-UP/TRANSFER ROLLERS

[75] Inventors: Thomas Acquaviva, Penfield; Alan G. Schlageter, Ontario; William Brant, Rochester; James M. Cassidy, Jr., Rochester; Joseph S. Vetromile, Rochester; Prashant K. Phadnis, Pittsford; Steven W. Baldwin, Fairport; John Lombino, Ontario; Lawrence D. Dipzinski, Macedon, all of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/808,412

[22] Filed: Feb. 28, 1997

[51] Int. Cl.[6] ..... G03G 15/20

[52] U.S. Cl. ..... 399/341; 399/406

[58] Field of Search ..... 399/325, 341, 399/406; 118/60, 680, 681; 219/216; 430/97, 99, 124

[56] References Cited

U.S. PATENT DOCUMENTS

| | | | |
|---|---|---|---|
| 2,614,522 | 10/1952 | Snyder . | |
| 2,925,800 | 2/1960 | Wassem . | |
| 3,292,572 | 12/1966 | Brenneisen et al. . | |
| 3,647,525 | 3/1972 | Dahlgren . | |
| 3,705,451 | 12/1972 | Dahlgren | 29/148.4 D |
| 4,041,197 | 8/1977 | Gagne | 118/60 X |
| 4,272,666 | 6/1981 | Collin | 219/216 |
| 4,541,707 | 9/1985 | Yoshinaga | 399/325 |
| 4,805,554 | 2/1989 | McIntyre | 118/60 X |
| 4,836,129 | 6/1989 | Dahlgren | 118/46 |
| 5,264,899 | 11/1993 | Mandel . | |
| 5,304,391 | 4/1994 | Rantanen | 427/8 |
| 5,374,983 | 12/1994 | Isogai | 399/325 |
| 5,434,029 | 7/1995 | Moser | 430/97 |
| 5,534,063 | 7/1996 | Maruyama et al. | 118/60 |
| 5,596,930 | 1/1997 | Keller et al. | 101/483 |

*Primary Examiner*—Robert Beatty
*Attorney, Agent, or Firm*—Kevin R. Kepner

[57] ABSTRACT

A paper conditioner to control image dependent curl which uses one or more counter-rotating transfer rollers which are initially spaced from their respective back-up rollers in the intercopy gap, and which come together as the lead edge enters the nip area, and separates when the trail edge is about to pass. This permits the rollers to have a less demanding runout tolerance by bringing the rollers together when the sheet is in the nip, and then articulating the rollers apart in the intercopy gap.

17 Claims, 2 Drawing Sheets

PAPER CONDITIONER WITH ARTICULATING BACK-UP/TRANSFER ROLLERS

Figure 1:
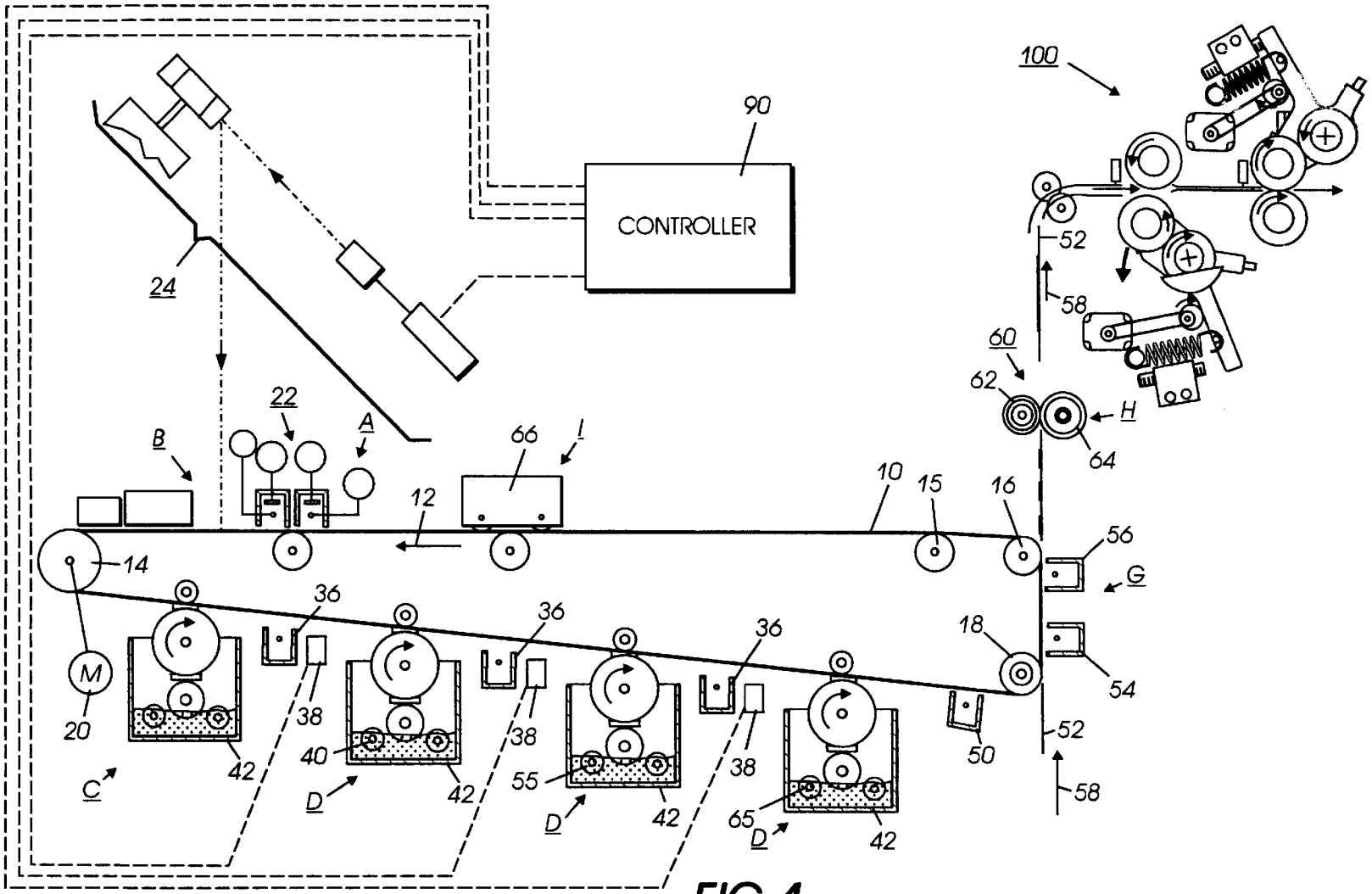

This invention relates generally to a substrate conditioning device for an electrophotographic printing machine and, more particularly, concerns a device to meter and apply moisture to cut sheets in a full color process printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling. One solution to this problem is set forth in U.S. patent application Ser. No. 07/695,838; the contents of which are hereby incorporated by reference.

A second problem associated with moisture loss in paper is paper waviness. As sheets pass through the fixing system, moisture is driven out and the sheet temperature is elevated. If after fixing, the sheet is then allowed to rest in a collection area fully exposed to its ambient surroundings, its moisture content will equilibrate with the environment through absorption of moisture across the full face of at least one side of the paper sheet. If, however, the copy sheet becomes part of a large compiled set, both sides of all of the papers in the compilation (except for the top sheet) will effectively be sealed off from the moisture within the atmosphere. The only route available to this desiccated paper for moisture reabsorption is through the edges of the sheets, leaving the moisture content of the central portions of the sheets relatively unchanged. This uneven pattern of moisture reabsorption results in edge stresses that lead to paper waviness along the edges of the paper. The resulting wave pattern may typically have an amplitude of ⅛ inch to ¼ inch.

In addition to being cosmetically unsightly, the edge wave creates a secondary handling problem, in that pages having such a wave pattern along their edges are more difficult to feed to secondary paper handling machines, such as a binder apparatus. For this reason, printers continue to favor the use of offset presses for large compilations.

A number of solutions to this problem have been advanced. One proposed solution is to use an offset press dampening system to add moisture to each sheet as it exits the copier. These systems typically rely on the generation of a pool of water at a roll interface to distribute the water evenly along the rolls. Such systems usually operate with a web paper supply and their use with a cut sheet feeder system creates some difficulties not previously contemplated or addressed. Normal dampening systems are more appropriate for use with conventional offset presses.

U.S. Pat. No. 4,375,327 attempts to solve the problem of wave curling as it arises due to another cause: adherence of paper to a roller fixing device—and does not address the problem caused by moisture loss. U.S. Pat. No. 4,652,110 (the contents of which are hereby incorporated by reference) attempts to replenish moisture lost in the fixing process by collecting moisture as it is driven off the copy sheet for reapplication to the sheet at a later time.

There remains a need for a system for preventing the edge waviness caused by the loss of moisture from the copy sheet during the fixing step of electrostatographic reproduction or printing that is practical for use with electrostatographic machines.

The conditioner described herein is located after the fuser and before a mechanical decurler. The function of the conditioner is to replace the moisture lost in the fusing process and thereby reduce image dependent curl. The approach taken to replace moisture is to drive a sheet between two closely spaced rollers: one roller called the back-up roller, is rubber coated and drives the sheet forward. The second roller, called the transfer roller, rotates in the opposite direction and applies a thin film of water to the paper on the side opposite to the back-up roller. The surface of the transfer roller is "wet" by passing through a flooded nip. The film thickness deposited on the transfer roll surface is determined by the pressure between the transfer roller and a metering roll. Two sets of these rollers are required to moisturize both sides of the sheet. One of the biggest problems is ensuring the close proximity between the back-up and transfer roller. They must be positioned so that they do not touch in the intercopy gap or else water will be applied to the surface of the back-up roller which will be applied to the opposite side of the sheet in an uncontrolled manner. Likewise, they must be close enough that the thinnest sheet can be effectively driven through the nip. This requires runout tolerances in the order of 0.0005" which is difficult and expensive to attain in production. This invention describes an alternate method of mounting the rollers which requires less demanding tolerances.

The following disclosures may be relevant to various aspects of the present invention:

U.S. Pat. No. 5,434,029
Inventor: Moser
Issue Date: Jul. 18, 1995

U.S. Pat. No. 5,264,899
Patentee: Mandel
Issued: Nov. 23, 1993

U.S. Pat. No. 3,705,451
Patentee: Dahlgren
Issued: Dec. 12, 1972

U.S. Pat. No. 3,647,525
Patentee: Dahlgren
Issued: Mar. 7, 1972

Portions of the foregoing disclosures may be briefly summarized as follows:

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aftermentioned nip.

U.S. Pat. No. 5,264,899 describes a system for adding moisture to a copy sheet is disclosed. The toner fixation step of electrostatographic reproduction desiccates paper, which may lead to the formation a wave along the sheet edge. The invention uses a pair of porous rolls defining a nip to transfer additional moisture to the copy sheet as It is passed through the nip. The added moisture prevents edge wave formation.

U.S. Pat. No. 3,705,451 describes a fluid transfer and material conditioning roller, and method of preparing same, wherein a metallic roller is chrome plated, the surface of the chrome plating is ground and polished to provide a very smooth, uninterrupted surface thereon, the surface is treated with a solution of chrome solvent such as hydrochloric, or sulfuric acid mixed with equal parts of water and gum arabic to remove chromium oxide from the surface thereof and to coat said surface with an oxidation-preventing coating to render the roller permanently hydrophilic.

U.S. Pat. No. 3,647,525 describes A method and apparatus for applying a controlled quantity of liquid to a moving web of liquid receptive material comprising a smoothly finished hydrophilic transfer roller in rotative pressure engagement with the web. Pressure between a smooth surfaced metering roller and the transfer roller is adjustable to accurately control the thickness of a film of fluid having low viscosity which is delivered by the transfer roller to the web. The relative surface speeds of the transfer roller and the web are adjustable to control the rate at which the metered film is delivered to the web and to control the hydraulic pressure exerted to the film to urge it into the web. A backup roller is employed to further control the hydraulic pressure of fluid transferred to the web. The metering roller and the transfer roller are skewed to regulate the moisture profile across the width of the web.

In accordance with one aspect of the present invention, there is provided a device for adding moisture to a copy sheet. The device comprising a reservoir for storing a quantity of liquid, a pair of generally cylindrical rolls, each having an outer cylindrical surface, said rolls being aligned with respect to one another along their axes so as to define a nip between said outer cylindrical surfaces, a metering device in circumferential surface contact with one of said rolls for controlling the flow of fluid from the reservoir to at least one of said rolls and a selectively actuable support mechanism to separate and engage said roll pair based upon the location of a sheet.

In accordance with another aspect of the invention there is provided a system for fixing a toner image to a copy sheet in an electrophotographic system so as to avoid the formation of a wave along the edge of the copy sheet. The system comprising first and second fusing rollers defining a nip therebetween, at least one of said fusing rollers being heated, wherein the fusing rollers serve to fix a toner image on a copy sheet through the application of heat and pressure to the copy sheet; a device to transport a copy sheet from said fusing rollers to a sheet conditioning system, comprising; a reservoir for storing a quantity of liquid, a pair of generally cylindrical rolls, each having an outer cylindrical surface, said rolls being aligned with respect to one another along their axes so as to define a nip between said outer cylindrical surfaces, a metering device circumferential surface contact with one of said rolls for controlling the flow of fluid from the reservoir to at least one of said rolls, and a selectively actuable support mechanism to separate and engage said roll pair based upon the location of a sheet.

In accordance with yet another aspect of the invention there is provided a method for replenishing the moisture that a copy sheet loses as it is heated in an electrophotographic machine of the type having a thermal fuser. The method comprising the steps of transporting liquid from a reservoir to a one of a pair of rolls that are arranged so as to form a nip therebetween when selectively engaged, transporting the copy sheet from the fuser through the nip of the rolls, transferring liquid from the rolls to said copy sheet and selectively disengaging the rolls when a sheet is not in the nip.

Figure 2:
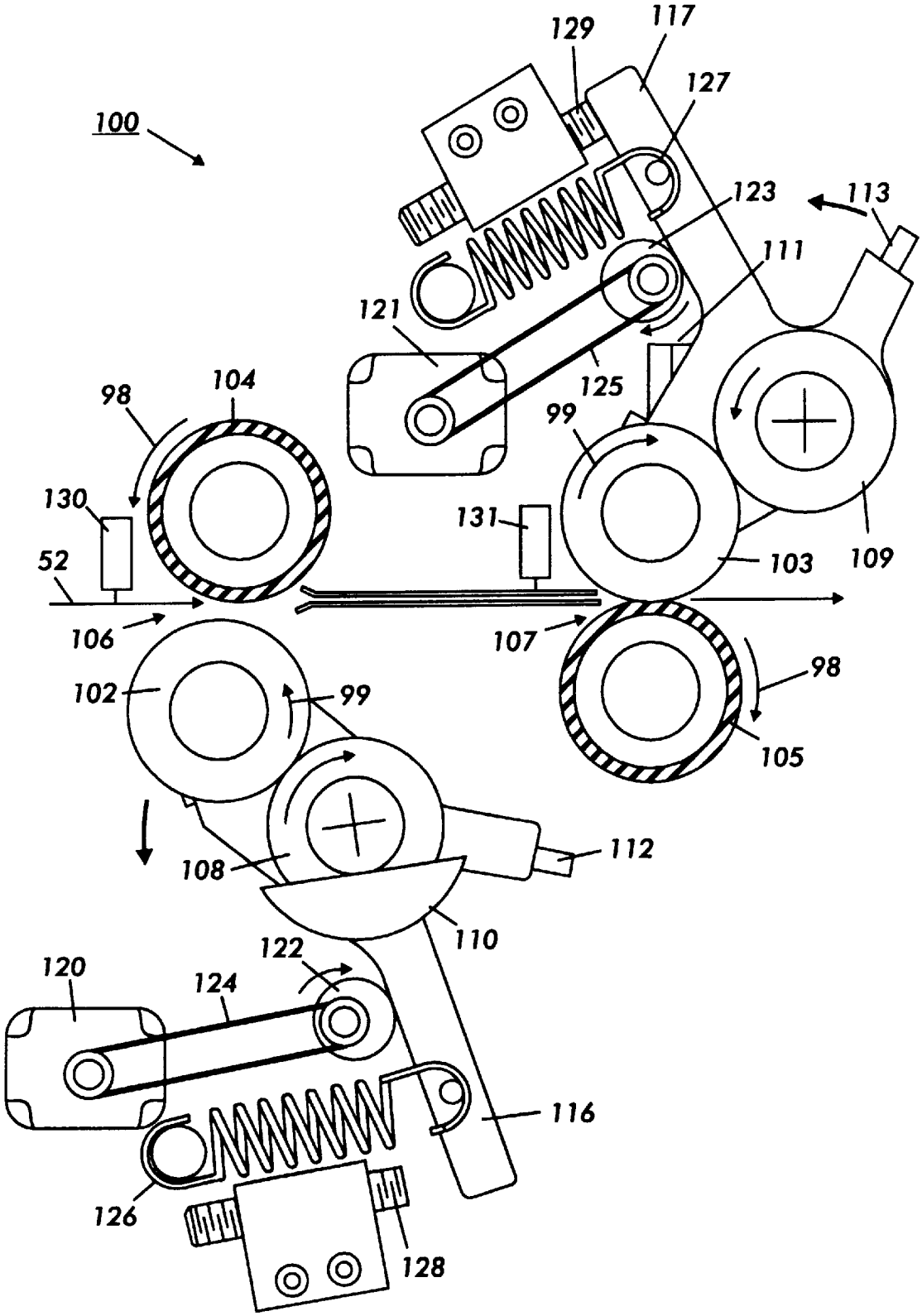

Other features of the present invention will become apparent as the following description proceeds and upon reference to the drawings, in which:

FIG. 1 is a schematic elevational view of a full color image-on-image single pass electrophotographic printing machine utilizing the device described herein; and FIG. 2 is a detailed elevational side view of the paper conditioning device.

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Turning now to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third imager for a third suitable color toner such as magenta and for a fourth imager and suitable color toner such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

As shown in FIG. 2, the sheet conditioning device, generally referred to as reference numeral 100, has transfer rollers 102, 103 which are articulated in an almost vertical direction, such that when the lead edge of incoming sheets 52 enter the nip areas 106, 107, the transfer rollers 102, 103 move towards the sheet 52 to engage the rotating back-up rollers 104, 105 which are in a fixed position. Likewise, when the trail edge of the sheet is about to exit the nips 106, 107, the transfer rollers 102, 103 move away from the sheet 52 to disengage the back-up rollers 104, 105. Springs 126, 127 provide the normal force for the transfer rollers 102, 103 against back up rollers 104, 105. Since the back-up rollers 104, 105 are rubber coated, a thick or thin sheet will deflect the rubber surface and provide the necessary drive force. The backup rollers 104, 105 are driven in the direction of arrows 98. The roller nips 106, 107 are disengaged in the intercopy gap, by say 0.015", and there is no danger that the back-up rollers 104, 105 will be wet.

The wetting agent, in this case water, is distributed to the transfer rollers 102, 103 from sumps 110, 111 by way of metering rolls 108, 109. The contact between the metering rolls 108, 109 and the transfer rolls 102, 103 can be adjusted by using adjuster screws 112, 113 which can be manually adjusted as shown, or the adjusters 112, 113 can be driven by a motor (not shown) or other device to provide automatic adjustment depending on the desired film thickness on the transfer roller. The sump 111 must be modified for the upper transfer roll 103/metering roll 109 assembly so that the wetting agent is prevented from dripping onto the sheet and producing undesireable wetting characteristics. This can be accomplished by utilizing a liquid dam in combination with the upper metering roll 109 to provide a flooded nip. The amount of moisture added to a sheet is a function of the relative velocity between the sheet 52 and the transfer rollers 102, 103, which transfer rollers 102, 103 are rotated in a direction opposite to the direction of the sheet as indicated by arrows 99.

A sensor 130 located upstream of the first moisturizing nip 106, detects lead and trail edge sheet position and provides the necessary timing to close and open the nips 106, 107. For example, if the sheet velocity when it is at the sensor 130, and the distance from the sensor 130 to each moisturizing nip 106, 107 are known, and the velocity between nips and sheet velocity in each nip is known, then it is a relatively simple algorithm to determine when to engage and disengage each nip. Alternately, a second sensor 131 can be used between the nips 106, 107 to assist in determining the proper sequencing of the nip engagement/disengagement.

There is illustrated only one of many methods of separating the nips 106, 107. In FIG. 2, there is shown two stepper motors 120, 121 driving two cams 122, 123. As each cam 122, 123 rotates in the clockwise direction, it separates the respective transfer roller 102, 103 from the respective back-up roller 104, 105. In the position illustrated by the cam 122, the nip 106 may be separated by 0.015". When the cams are in the position illustrated by cam 123, the cam surface is not touching the pivot arm 117, but the contact dimension is determined by the adjustment screw 129. A similar screw 128 is provided for arm 116. This scheme uses two stepper motors 120, 121 driving cams 122, 123 through drive members 124, 125. Alternate methods might employ solenoids, clutches, cables etc. Likewise, alternate methods might articulate the back-up rollers 104, 105 instead of the transfer rollers 102, 103.

In recapitulation, there is provided a paper conditioner to control image dependent curl which uses one or more counter-rotating transfer rollers which are initially spaced from their respective back-up rollers in the intercopy gap, and which come together as the lead edge enters the nip area, and separate when the trail edge is about to pass.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for adding moisture to a copy sheet after it has been fused, comprising:

a fusing device;

a reservoir for storing a quantity of liquid;

a pair of generally cylindrical rolls located subsequent to said fusing device, each having an outer cylindrical surface, said rolls being aligned with respect to one another along their axes so as to define a nip between said outer cylindrical surfaces;

a metering device in circumferential surface contact with one of said rolls for controlling the flow of fluid from the reservoir to at least one of said rolls; and a selectively actuable support mechanism to separate and engage said roll pair based upon the location of a sheet, wherein said roll pair does not engage without a sheet in the nip defined thereby and each roll of said roll pair rotates in opposite directions at the nip region to achieve a relative velocity between a fluid roll and the sheet so as to optimize the desired wetting characteristics.

2. An apparatus according to claim 1, wherein said roll pair comprises;

a first roll having an elastomeric coating to drive a sheet in a first direction through the nip; and a second roll, for applying liquid to a side of the sheet opposite the side that contacts said first roll, said second roll having a smooth outer cylindrical surface, wherein said second roll rotates in a direction opposite the direction of said first roll.

3. An apparatus according to claim 1, wherein said metering device comprises;

a metering roll in circumferential contact with one of said pair of cylindrical rolls and further in contact with the liquid in said reservoir; and an adjuster, to vary the contact force between said metering roll and the one of said pair of cylindrical rolls so as to vary the amount of liquid transferred thereto.

4. An apparatus according to claim 1, wherein said selectively actuable support mechanism comprises;

an elongated support for securing said metering device and one of said pair of cylindrical rolls in an adjusted relationship and pivotably mounted so that said one of said pair of cylindrical rolls is moveable from a position in contact with the second of said pair of cylindrical rolls to a position removed therefrom;

an actuator, connected to said elongated support to pivotalbly move said elongated support so that said one of said pair of cylindrical rolls is moved from a position in contact with the second of said pair of cylindrical rolls to a position removed therefrom.

5. An apparatus according to claim 1, further comprising a sensor, located adjacent said pair of rolls to sense a lead edge of a sheet and to generate a signal indicative thereof.

6. An apparatus according to claim 5, wherein said roll pair comprises;

a first roll having an elastomeric coating to drive a sheet in a first direction through the nip; and a second roll, for applying liquid to a side of the sheet opposite the side that contacts said first roll, said second roll having a smooth outer cylindrical surface, wherein said second roll rotates in a direction opposite the direction of said first roll.

7. An apparatus according to claim 5, wherein said metering device comprises;

a metering roll in circumferential contact with one of said pair of cylindrical rolls and further in contact with the liquid in said reservoir; and an adjuster, to vary the contact force between said metering roll and the one of said pair of cylindrical rolls so as to vary the amount of liquid transferred thereto.

8. An apparatus according to claim 5, wherein said selectively actuable support mechanism comprises;

an elongated support for securing said metering device and one of said pair of cylindrical rolls in an adjusted relationship and pivotably mounted so that said one of said pair of cylindrical rolls is moveable from a position in contact with the second of said pair of cylindrical rolls to a position removed therefrom;

an actuator responsive to the signal from said sensor, connected to said elongated support to pivotalbly move said elongated support so that said one of said pair of cylindrical rolls is moved from a position in contact with the second of said pair of cylindrical rolls to a position removed therefrom.

9. An apparatus for fixing a toner image to a copy sheet in an electrophotographic system so as to avoid the formation of a wave along the edge of the copy sheet and a curl in the body of the sheet, comprising:

first and second fusing rollers defining a nip therebetween, at least one of said fusing rollers being heated, wherein the fusing rollers serve to fix a toner image on a copy sheet through the application of heat and pressure to the copy sheet;

a device to transport a copy sheet from said fusing rollers to a sheet conditioning system, comprising;

a reservoir for storing a quantity of liquid, a pair of generally cylindrical rolls, each having an outer cylindrical surface, said rolls being aligned with respect to one another along their axes so as to define a nip between said outer cylindrical surfaces, a metering device circumferential surface contact with one of said rolls for controlling the flow of fluid from the reservoir to at least one of said rolls, and a selectively actuable support mechanism to separate and engage said roll pair based upon the location of a sheet, wherein said roll pair does not engage without a sheet in the nip defined thereby.

10. An apparatus according to claim 9, wherein said roll pair comprises;

a first roll having an elastomeric coating to drive a sheet in a first direction through the nip; and a second roll, for applying liquid to a side of the sheet opposite the side that contacts said first roll, said second roll having a smooth outer cylindrical surface, wherein said second roll rotates in a direction opposite the direction of said first roll.

11. An apparatus according to claim 9, wherein said metering device comprises;

a metering roll in circumferential contact with one of said pair of cylindrical rolls and further in contact with the liquid in said reservoir; and an adjuster, to vary the contact force between said metering roll and the one of said pair of cylindrical rolls so as to vary the amount of liquid transferred thereto.

12. An apparatus according to claim 9, wherein said selectively actuable support mechanism comprises;

an elongated support for securing said metering device and one of said pair of cylindrical rolls in an adjusted relationship and pivotably mounted so that said one of said pair of cylindrical rolls is moveable from a position in contact with the second of said pair of cylindrical rolls to a position removed therefrom;

an actuator, connected to said elongated support to pivotalbly move said elongated support so that said one of said pair of cylindrical rolls is moved from a position in contact with the second of said pair of cylindrical rolls to a position removed therefrom.

13. An apparatus according to claim 9, further comprising a sensor, located adjacent said pair of rolls to sense a lead edge of a sheet and to generate a signal indicative thereof.

14. An apparatus according to claim 13, wherein said roll pair comprises;

a first roll having an elastomeric coating to drive a sheet in a first direction through the nip; and a second roll, for applying liquid to a side of the sheet opposite the side that contacts said first roll, said second roll having a smooth outer cylindrical surface, wherein said second roll rotates in a direction opposite the direction of said first roll.

15. An apparatus according to claim 13, wherein said metering device comprises;

a metering roll in circumferential contact with one of said pair of cylindrical rolls and further in contact with the liquid in said reservoir; and an adjuster, to vary the contact force between said metering roll and the one of said pair of cylindrical rolls so as to vary the amount of liquid transferred thereto.

16. An apparatus according to claim 13, wherein said selectively actuable support mechanism comprises;

an elongated support for securing said metering device and one of said pair of cylindrical rolls in an adjusted relationship and pivotably mounted so that said one of said pair of cylindrical rolls is moveable from a position in contact with the second of said pair of cylindrical rolls to a position removed therefrom;

an actuator responsive to the signal from said sensor, connected to said elongated support to pivotalbly move said elongated support so that said one of said pair of cylindrical rolls is moved from a position in contact with the second of said pair of cylindrical rolls to a position removed therefrom.

17. A method for replenishing the moisture that a copy sheet loses as it is heated in an electrophotographic machine of the type having a thermal fuser, comprising the steps of:

transporting liquid from a reservoir to a one of a pair of rolls that are arranged so as to form a nip therebetween when selectively engaged;

transporting the copy sheet from the fuser through the nip of the rolls;

transferring liquid from the rolls to said copy sheet; and selectively disengaging the rolls when a sheet is not in the nip, wherein said roll pair does not engage without a sheet in the nip defined thereby.

* * * * *